US007371050B2

(12) United States Patent
Pasquiet

(10) Patent No.: US 7,371,050 B2
(45) Date of Patent: May 13, 2008

(54) DEVICE FOR AXIALLY RETAINING BLADES ON A TURBOMACHINE ROTOR DISK

(75) Inventor: Didier Pasquiet, Boissise le Roi (FR)

(73) Assignee: Snecma, Paris (FR)

( * ) Notice: Subject to any disclaimer, the term of this patent is extended or adjusted under 35 U.S.C. 154(b) by 458 days.

(21) Appl. No.: 11/085,585

(22) Filed: Mar. 22, 2005

(65) Prior Publication Data

US 2005/0271511 A1 Dec. 8, 2005

(30) Foreign Application Priority Data

Apr. 9, 2004 (FR) ..... 04 03738

(51) Int. Cl.
*F01D 5/30* (2006.01)

(52) U.S. Cl. ..... 416/204 A; 416/220 R; 416/221; 416/244 R

(58) Field of Classification Search ..... 416/220 R, 416/221, 204 A, 244 A
See application file for complete search history.

(56) References Cited

U.S. PATENT DOCUMENTS 3,096,074 A 7/1963 Pratt et al.
4,304,523 A * 12/1981 Corsmeier et al. ..... 416/221
4,890,981 A * 1/1990 Corsmeier et al. ..... 416/220 R
6,106,234 A * 8/2000 Gabbitas ..... 416/221
6,520,743 B2 * 2/2003 Arilla et al. ..... 416/220 R

FOREIGN PATENT DOCUMENTS

| | | |
|---|---|---|
| EP | 1 096 107 A2 | 5/2001 |
| EP | 1 439 282 A1 | 7/2004 |
| FR | 2 819 290 | 7/2002 |

* cited by examiner

*Primary Examiner*—Igor Kershteyn
(74) *Attorney, Agent, or Firm*—Oblon, Spivak, McClelland, Maier & Neustadt, P.C.

(57) ABSTRACT

A device for axially retaining blades on a rotor disk of a turbomachine, includes an annulus which is mounted via a radially inner edge in an annular groove of the disk and which presses against the roots of the blades mounted in grooves in the periphery of the disk, and an annular lock received in the annular groove of the disk to prevent the annulus from turning, the annular lock being turnable in the annular groove between an annulus-locking position and a position for mounting and dismounting in the annular groove.

10 Claims, 6 Drawing Sheets

DEVICE FOR AXIALLY RETAINING BLADES ON A TURBOMACHINE ROTOR DISK

The present invention relates to a device for axially retaining blades on a rotor disk, in particular in a high-pressure compressor or a high-pressure turbine of a turbomachine such as a turbojet.

BACKGROUND OF THE INVENTION

To perform this retention function, it is known to use an annulus whose radially inner edge is received in an annular groove of the downstream face of the rotor disk and whose radially outer edge bears against the downstream ends of the roots of blades that are engaged in axial grooves in the periphery of the disk.

The radially outer edge of the annular groove in the disk and the radially inner edge of the annulus are of complementary festooned or crenellated shapes, thus enabling the annulus to be brought into the annular groove of the disk by being moved in axial translation when the solid portions of the festooned edge of the annulus are in alignment with the gap portions of the festooned edge of the annular groove, and then to secure the annulus axially in the annular groove by turning it so that the solid portions of its festooned edge come into alignment with the solid portions of the festooned edge of the annular groove of the disk, which then bear thereagainst.

On its face facing towards the blade roots, the radially outer portion of the annulus has studs for engaging in corresponding cavities in the blade roots and which serve to prevent the annulus from turning about its axis.

In the locking position, the annulus is held axially by its portions bearing against the blade roots, against the downstream face of the disk, and against the festooned edge of the annular groove in the disk. To bring it into this position by turning it in the annular groove, it is necessary to deform it by pulling its radially outer portion axially and by pushing its radially inner portion axially, respectively to move the above-mentioned studs away from the ends of the blade roots until the studs are in register with the cavities that are to receive them, and in order to cause the solid portions of the festooned edge of the annulus to pass into the annular groove of the disk.

Such assembly is complicated to perform and requires the use of special tooling. Since the annuluses must withstand very high temperatures and since they are made of a sintered material that is very sensitive to scratching (where such scratches constitute crack starters and can greatly reduce the lifetime of the annulus), it is necessary to take great precautions to avoid damaging the annuluses while they are being mounted on the disk.

In addition, the studs must be machined and formed in the material of the annuluses, which is lengthy and extremely expensive. It is also necessary to machine the cavities for receiving the studs at the ends of the blade roots, and that also increases costs.

OBJECTS AND SUMMARY OF THE INVENTION

The invention seeks in particular to avoid those drawbacks of the prior art.

An object of the invention is to provide a device of the above-specified type for axially retaining blade roots on a rotor disk, the device not requiring special machining of the annuluses and making it easier to mount and dismount annuluses on rotor disks, while also reducing the risk of damaging the annuluses while mounting them.

To this end, the invention provides a device for axially retaining blades on a rotor disk of a turbomachine, the device comprising an annulus that is mounted via a radially inner edge in an annular groove of the disk, and that bears via a radially outer edge against the roots of the blades mounted in grooves in the periphery of the disk, the device further comprising an annular lock received in the annular groove of the disk to prevent the annulus from turning in said annular groove, said lock being turnable in the annular groove between an annulus-locking position and a position for mounting and dismounting in the annular groove.

The annular lock of the invention makes it unnecessary to machine studs on the annulus and cavities for receiving the studs in the blade roots. In addition, the annulus can be locked in position for retaining the blade rotors without deforming the annulus, thus reducing the risk of damaging it.

According to another characteristic of the invention, the lock has hooks for engaging by elastic snap-fastening on the radially inner edge of the annulus and between the solid portions of the festooned or crenellated edge of the annular groove in the annulus-locking position.

Thus, a single operation of snap-fastening the lock on the annulus suffices to prevent the annulus from turning, and this operation can be performed using means that are simple.

The hooks of the annular lock are formed on the solid portions of its festooned radially inner portion.

In a preferred embodiment of the invention, the hooks of the lock comprise radial tabs extending towards the axis of the lock from a radially outer annular portion thereof, and axial tabs connected to the radial tabs at one of their ends, and terminating at their other ends in respective catches facing radially outwards and forming members for retaining the radially inner edge of the annulus.

The lock can be snap-fastened on the annulus by elastically deforming the axial tabs and the radial tabs of the hooks.

In the locking position of the annulus, the solid portions of the festooned or crenellated edge of the annulus are aligned automatically with the solid portions of the festooned edge of the annular groove because of the hooks of the lock engaging in the gap portions of the festooned annular edge of the groove of the disk.

Advantageously, the above-mentioned axial tabs of the hooks are extended at their ends carrying the catches by second radial tabs extending in the opposite direction to the catches.

These radial tabs engage accurately in the gap portions of the edge of the annular groove of the disk and advantageously include means such as orifices for catching or engaging tools making it possible, by traction, to snap the catches against the edge of the annulus, and by thrust, to disengage the catches from the edge of the annulus, in order to dismount the annulus.

In its annulus-locking position, the radially outer portion of the annular lock is pressed axially against the radially inner portion of the annulus which is pressed axially against the solid portions of the festooned edge of the annular groove and which is clamped axially between the radially outer-portion of the annular lock and the catches of the hooks formed on the radially inner portion of said lock.

BRIEF DESCRIPTION OF THE DRAWINGS

Other details, characteristics, and advantages of the invention appear on reading the following description made by way of non-limiting example and with reference to the accompanying drawings, in which.

MORE DETAILED DESCRIPTION

Figure 1:
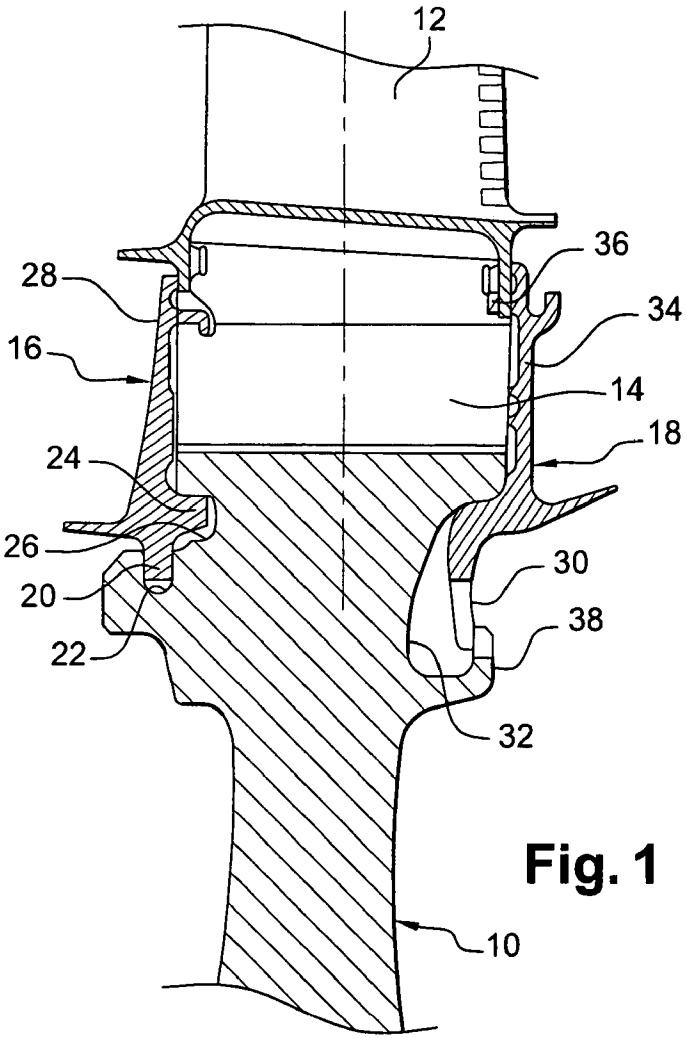
FIG. 1 is a fragmentary diagrammatic axial section view of a turbomachine rotor disk carrying a prior art downstream annulus for retaining blade roots.

Reference is made initially to FIG. 1, showing the art prior to the present invention.

The rotor of a compressor or a high-pressure turbine of a turbomachine comprises a plurality of rotor disks, one of which is shown in part in FIG. 1, each disk 10 carrying a plurality of substantially radial blades 12 having roots 14 engaged in axial grooves, e.g. of dovetail shape, in the periphery of the disk 10.

The blades 12 mounted on the disk 10 are prevented from moving axially in the grooves by an upstream annulus 16 and a downstream annulus 18 mounted on the disk.

On its radially inner portion, the upstream annulus 16 has an inner annular rim 20 facing radially inwards and housed in an annular groove 22 of the upstream face of the disk 10, and a cylindrical rim 24 facing downstream and inserted in a cylindrical groove 26 in the upstream face of the disk 10. The radially outer portion 28 of the upstream annulus 16 bears against the upstream ends of the roots 14 of the blades 12 of the disk 10, thereby retaining them axially in the upstream direction.

The downstream annulus 18 has a radially inner portion 30 with an edge that is "festooned" or crenellated, i.e. that presents solid portions alternating with gap portions that are regularly distributed around the circumference of the annulus 18, and that are received in an annular groove 32 of the downstream face of the disk 10. The radially outer portion 34 of the downstream annulus 18 bears against the downstream ends of the roots 14 of the blades 12, thereby retaining them axially in the downstream direction.

The downstream annulus 18 is prevented from turning about the axis of the disk 10 by means of a plurality of studs 36 provided on the upstream face of its radially outer portion 34 and designed to engage in corresponding cavities in the roots 14 of the blades 12.

The radially inner annular edge 38 of the groove 32 is "festooned" or crenellated as is the inner annular edge 30 of the annulus 18, thus enabling the inner edge 30 of the annulus 18 to be engaged in the groove 32 by movement in axial translation, and enabling it subsequently to be held in position axially by being turned in the groove 32 until the solid portions of the "festooned" or crenellated inner edge 30 of the annulus 18 come into alignment with the solid portions of the edge 38 of the groove 32, and bear against said solid portions.

In the position shown in FIG. 1, the annulus 18 is axially constrained since its radially outer portion 34 is pressed against the ends of the rotors 14 of the blades 12, and since its radially inner portion 30 is pressed against the rim 38 of the groove 32.

Thus, in order to put the annulus 18 into place, it is necessary to use special tooling enabling traction to be applied to its outer portion 34 and thrust to its inner portion 30, and then enabling the annulus to be turned in the groove 32, with the accompanying risk of the annulus 18 being scratched and damaged, as mentioned above.

Figure 2:
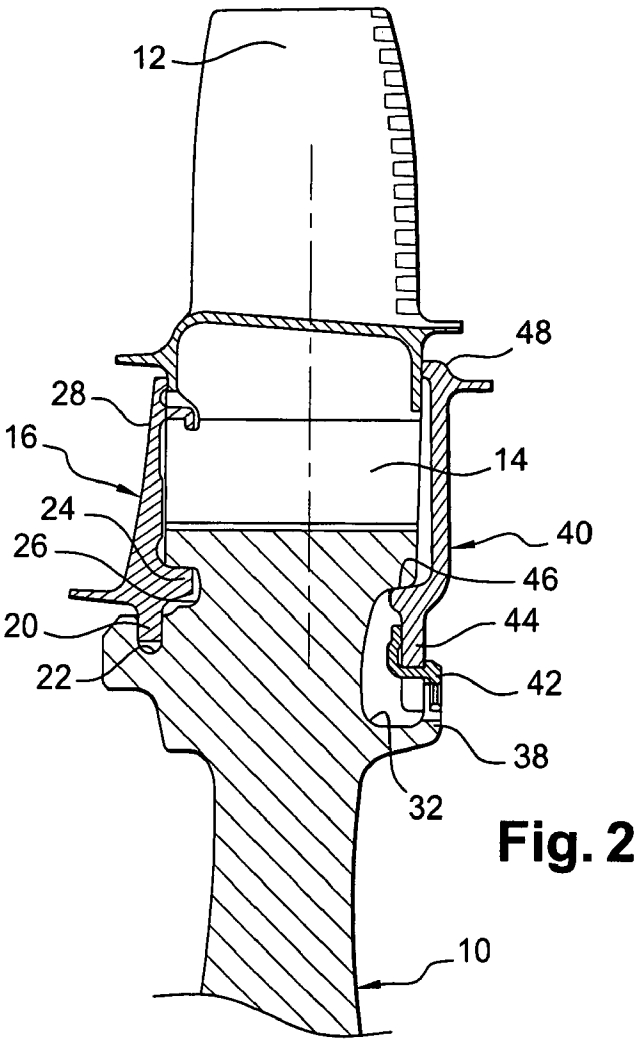
FIG. 2 is a fragmentary diagrammatic axial section view of a turbomachine rotor disk having a device of the invention for axially retaining the blade roots.

The device of the invention, as shown in FIG. 2 et seq., serves to avoid those drawbacks, and also to avoid the need to machine studs 36 on the outer portion of the annulus 18 and the need to machine corresponding cavities for receiving them in the roots 14 of the blades 12.

The device comprises an annulus 40 associated with an annular lock 42 which is mounted in the groove 32 of the disk 10 and which is made of any suitable material, and in particular of metal.

The annulus 40 corresponds essentially to the annulus 18 of FIG. 1, except that it does not have any studs 36, but does have an inner annular rim 44 received in the annular groove 32 of the disk 10, and a cylindrical bearing surface 46 formed on its upstream face to engage with a small amount of clearance against the inside of the radially outer peripheral edge of the annular groove 32, so as to center the annulus 40 relative to the disk 10.

The downstream annulus 40 also includes on its radially outer portion a cylindrical peripheral rim 48 facing upstream and pressed against the downstream ends of the roots 14 of the blades 12, thus serving to retain them axially in the downstream direction.

Figure 4:
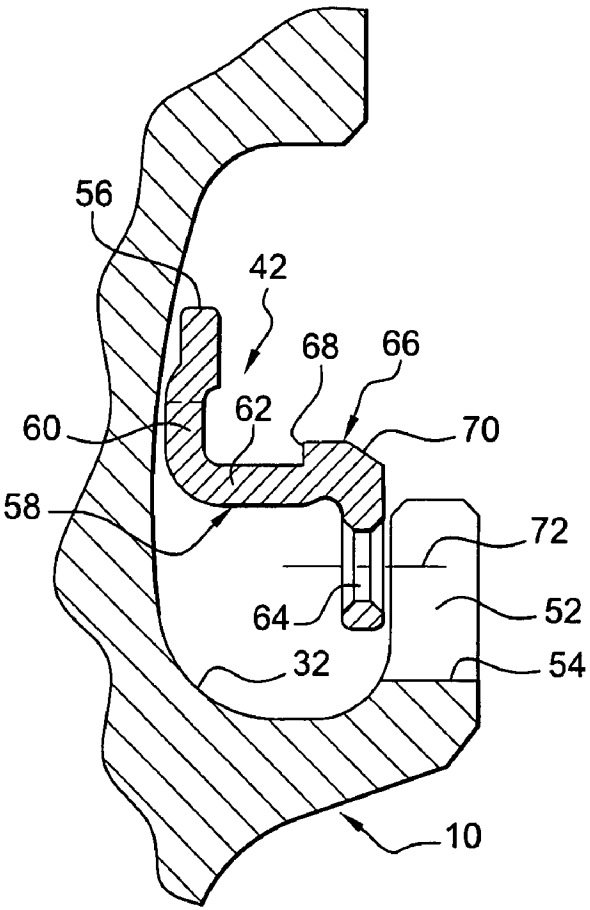
FIG. 4 is a fragmentary diagrammatic axial section of FIG. 3.
Figure 3:
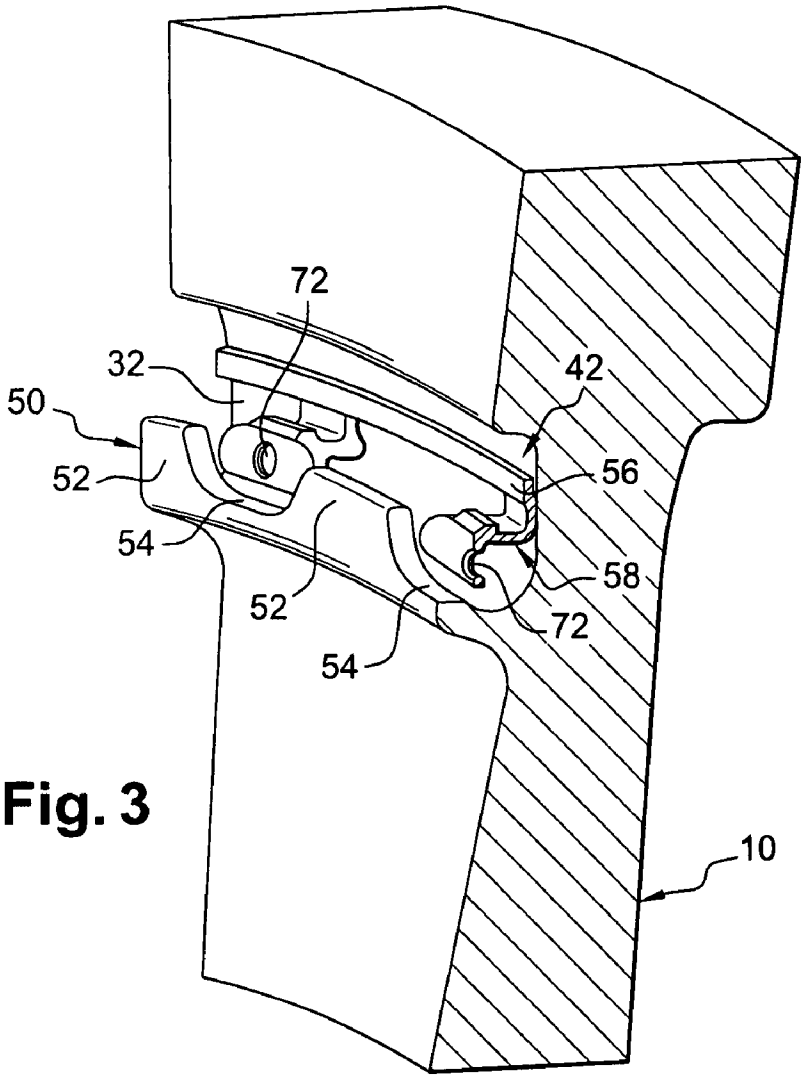
FIG. 3 is a fragmentary diagrammatic perspective view showing an annular lock of the device of the invention, housed in an annular groove of the disk.

The annular lock 42 can be seen more clearly in FIGS. 3 and 4 where it is shown engaged after axial translation in the annular groove 32 whose "festooned" or crenellated radially inner edge 50 comprises solid portions 52 alternating with gap portions 54 that are regularly distributed around the circumference of the groove 32.

The lock 42 essentially comprises a flat radial ring 56 having hooks 58 depending therefrom for co-operating with the "festooned" or crenellated inner edges of the annulus 40 and of the groove 32. The number of hooks 58 may be equal to the number of gap portions 54 in the edge 50, or it may be smaller than said number, with the hooks 58 being distributed around the circumference of the lock 42.

The hooks 58 extend downstream relative to the flat ring 56 and comprise first radial tabs 60 extending from the ring 56 towards the axis of the lock 42, axial tabs 62 connected to the radially inner ends of the first radial tabs 60 and extending downstream relative to the disk 10, and second radial tabs 64 connected to the downstream ends of the axial tabs 62 and extending towards the axis of the lock 42.

The axial tabs 62 of the hooks 58 have respective catches 66 for engaging against the inner edge 44 of the annulus 40, each catch 66 comprising a radial upstream face 68 and a sloping or chamfered downstream face 70.

The second radial tabs 64 of the hooks 58 have orifices 72 for enabling said tabs 64 to be caught or engaged by tools, as described in greater detail below.

The radial size of the ring 56 is small relative to that of the groove 32 in the disk 10, and the second radial tabs 64 of the hooks 58 are of shape and dimensions that are substantially complementary to those of the gap portions 54 in the edge 50 of the groove 32 so that the lock 42 can be engaged in the groove 32 by being moved in axial translation without being deformed when its second radial tabs 64 are in alignment with the gap portions 54 of the edge 50 of the groove 52, as shown in FIG. 3.

Figure 5:
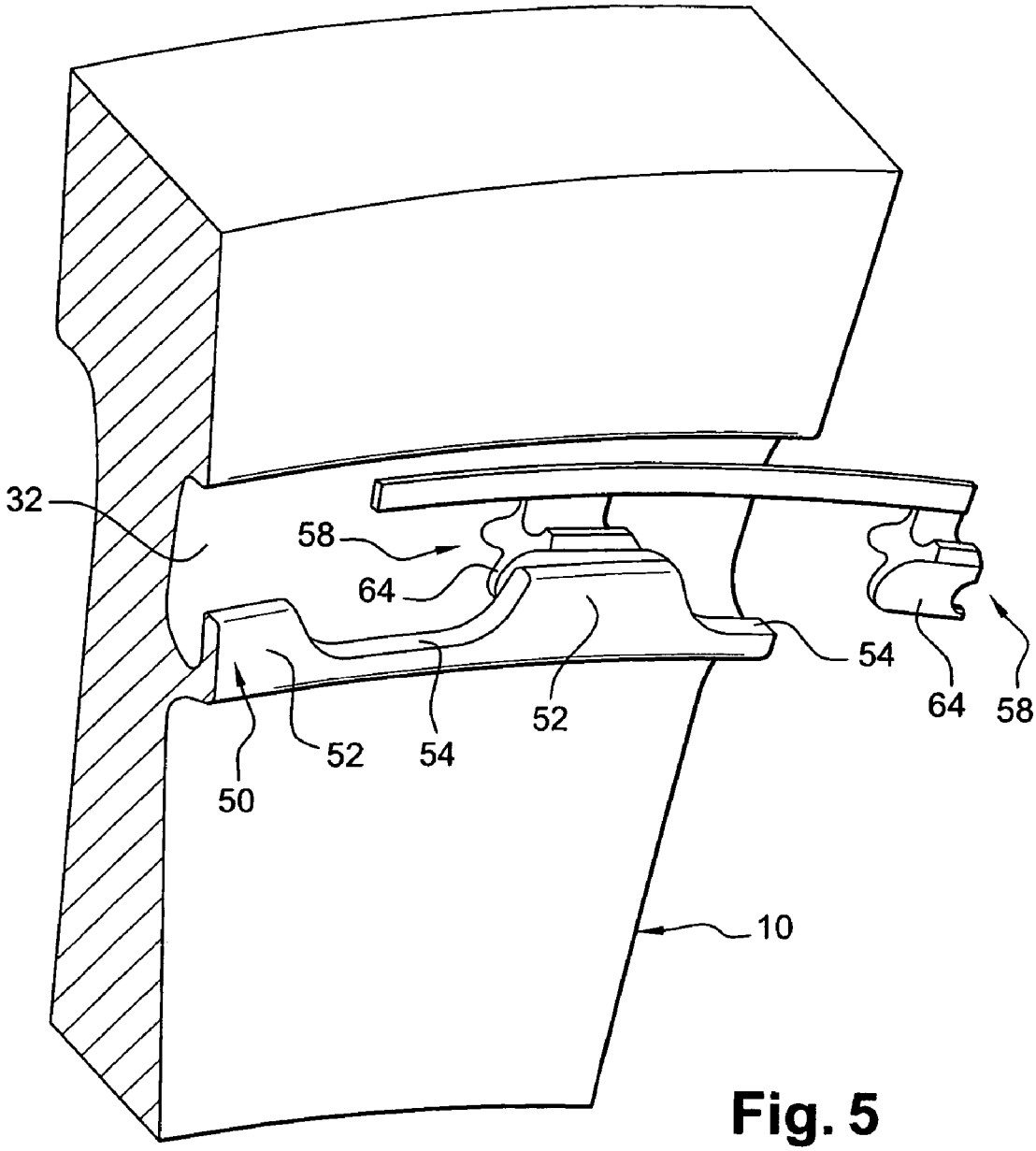
FIG. 5 is a fragmentary diagrammatic perspective view showing an annular lock in a position for mounting the annulus in the annular groove of the disk.

Thereafter, the lock 42 is turned about the axis of the disk 10 inside the annular groove 32 from the position shown in FIG. 3 to an annulus-mounting position as shown in FIG. 5.

Figure 6:
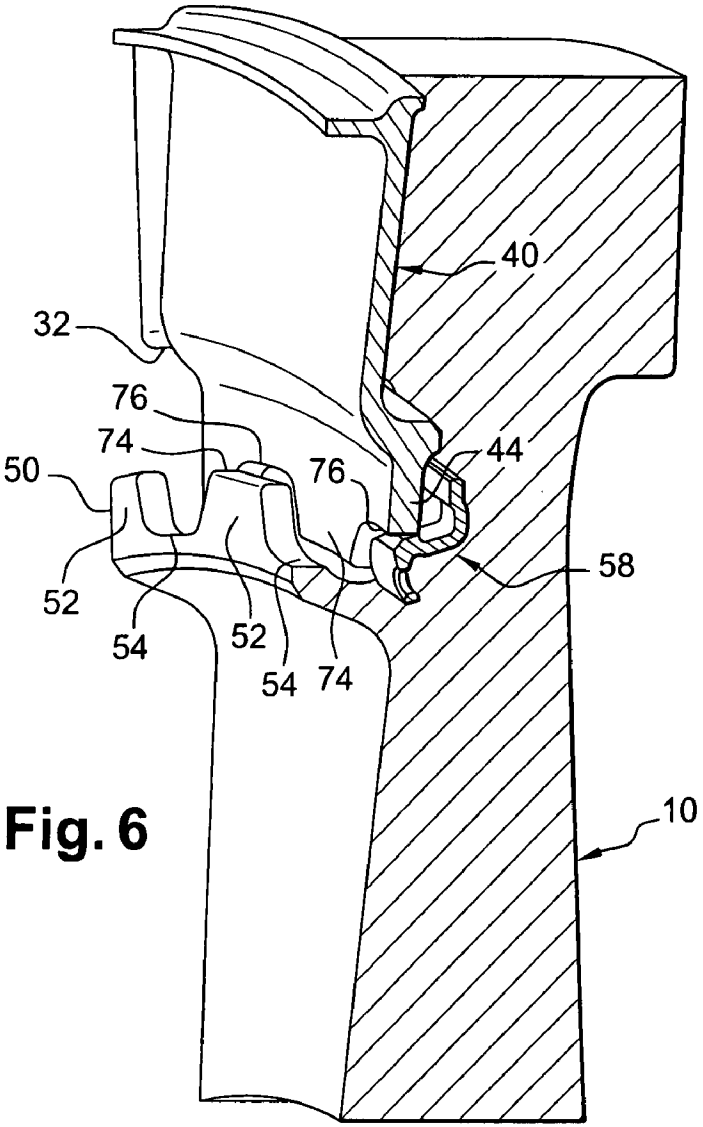
FIG. 6 is a fragmentary diagrammatic view showing the annulus mounted on the annular lock in the annular groove of the disk.

In this position, the second radial tabs 64 of the hooks 58 are in alignment with the solid portions 52 of the edge 50 of the groove 32 so as to enable the gap portions 54 of the edge 50 of the groove 32 to receive the solid portions of the radially inner edge 44 of the annulus 40, as shown in FIG. 6.

The radially inner edge 44 of the downstream annulus 40 is "festooned" or crenellated and comprises solid portions 74 alternating with gap portions 76 regularly distributed over the circumference of the annulus 40.

The "festooned" edge 44 of the annulus 40 is complementary to the "festooned" edge 50 of the groove 32, such that when the lock 42 is in the annulus-mounting position 40 as shown in FIG. 5, the annulus 40 can be inserted into the groove 32 by being moved in axial translation, the solid portions 74 of its edge 44 being in alignment with the gap portions 54 of the edge 50 of the groove 32.

Figure 7:
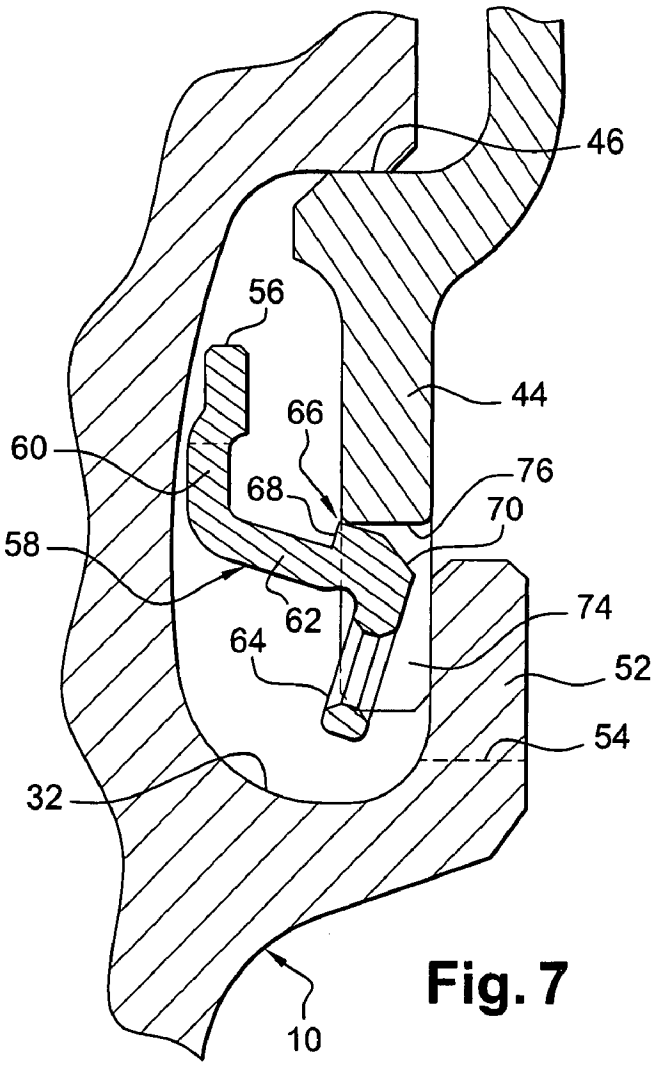
FIG. 7 is a fragmentary diagrammatic axial section of FIG. 6.

Movement in axial translation of the annulus 40 towards the disk 10 is continued until the radially inner edge 44 of the annulus 40 is fully engaged in the groove 32, as shown in FIG. 7, with its cylindrical bearing surface 46 engaged against the outer edge of the groove 32, the radially outer portion of the annulus 40 pressing against the ends of the roots 14 of the blades 12.

The gap portions 76 of the crenellated edge 44 of the annulus 40 are of outside diameter that is less than the outside diameter of the catches 66, such that during engagement of the edge 44 of the annulus 40 in the groove 32, the hooks 58 deform elastically by the catches 66 bearing against the bottoms of the gap portions 76 in the edge 44 of the annulus 40. The first radial tabs 60 and the axial tabs 62 of the hooks 58 deform and the angular spacing between them is changed, e.g. going from an angle of about 90° to an angle about 120°, with the second radial tabs 64 being pushed towards the axis of the disk 10 without being deformed.

The sloping or chamfered downstream faces 70 of the catches 66 encourage engagement of the annulus 40 on the catches 66 of the hooks 58 and encourage the tabs 60 and 62 of the hooks 58 to be deformed into the position of FIG. 7, where it can be seen that the lock 42 is pushed towards the bottom of the groove 32.

Figure 8:
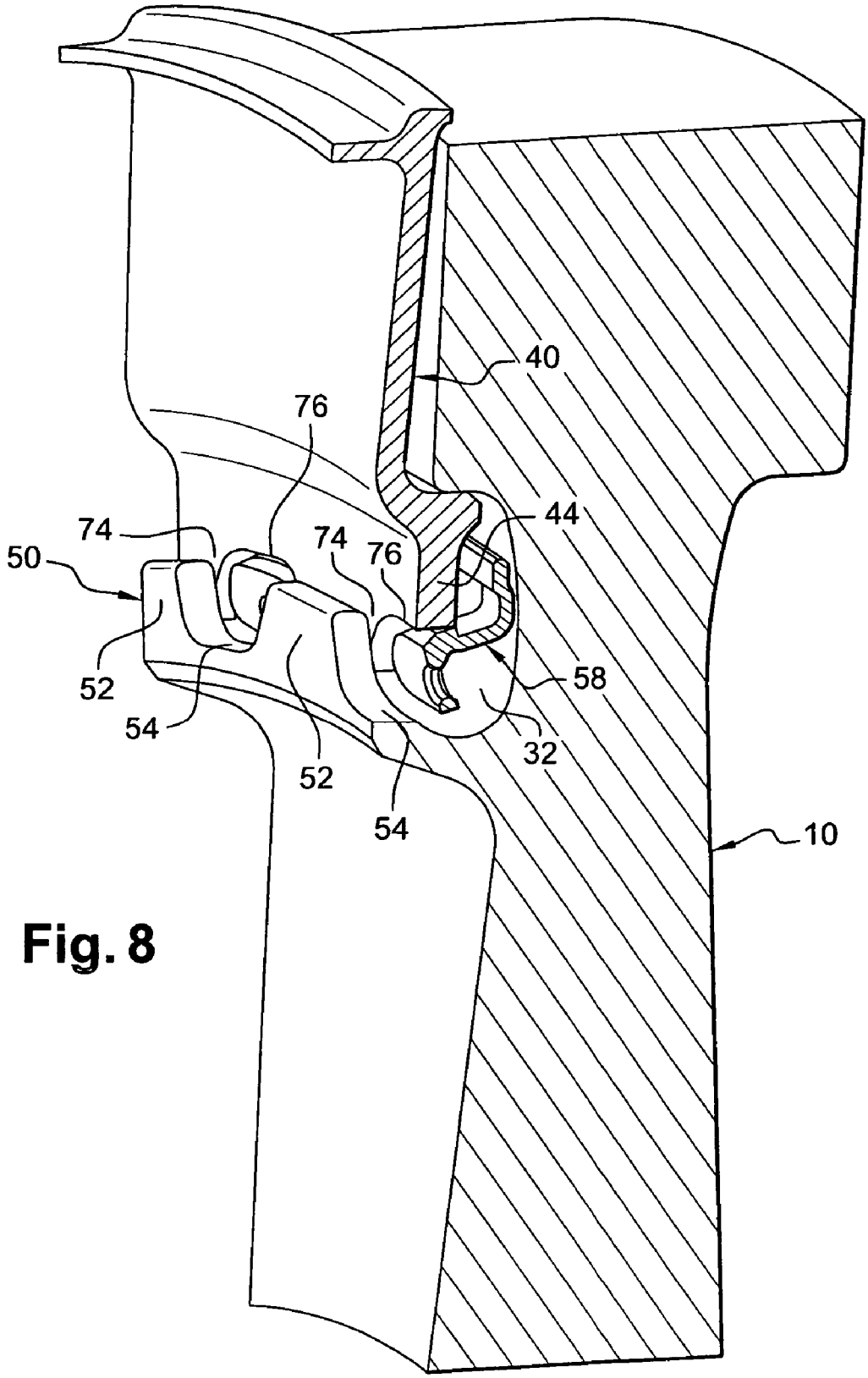
FIG. 8 is a fragmentary diagrammatic view showing the annulus and the annular lock in an intermediate locking position.

Thereafter, the annulus 40 is moved together with the lock 42 by being turned about the axis of the disk 10 in the annular groove 32 away from its mounting position as shown in FIG. 6 and into its locking position as shown in FIG. 8.

Figure 10:
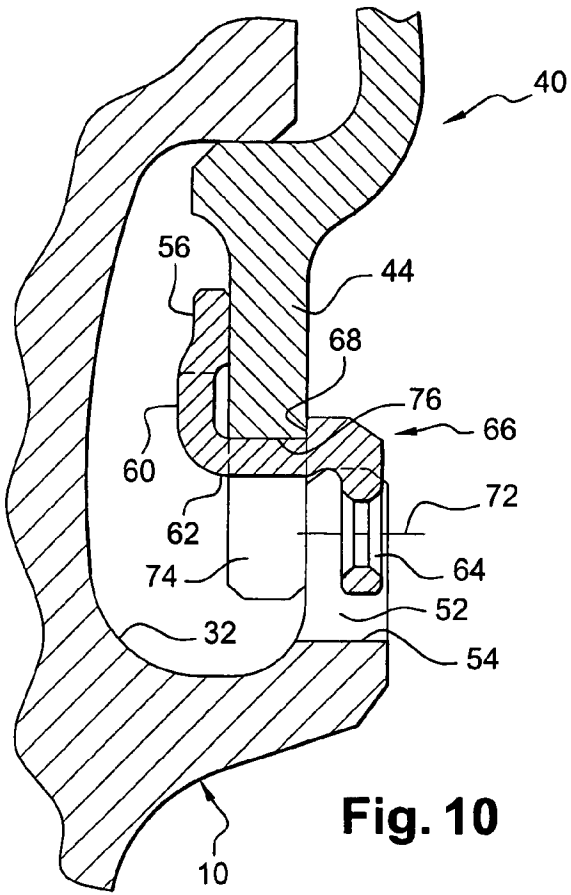
FIG. 10 is a fragmentary diagrammatic axial section of FIG. 9.
Figure 9:
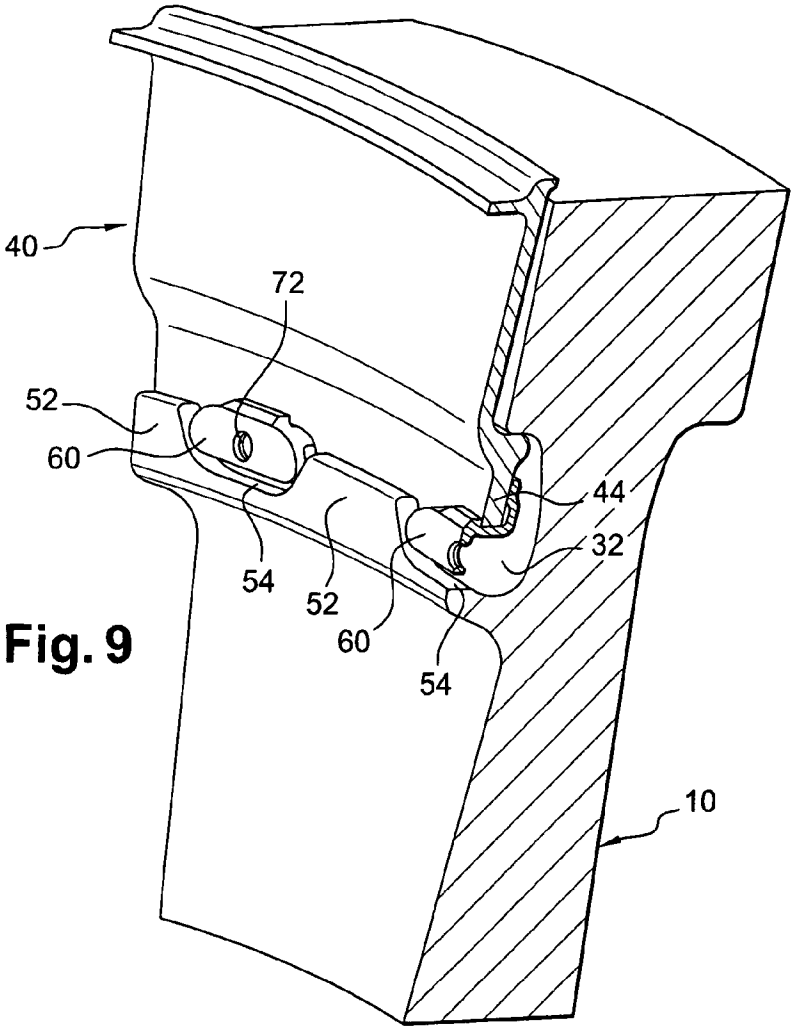
FIG. 9 is a fragmentary diagrammatic view in perspective showing the annulus and the annular lock in the final locking position.

In this locking position, the solid portions 74 of the radially inner edge 44 of the annulus 40 are in alignment with the solid portions 52 of the edge 50 of the groove 32. The lock 42 has turned together with the annulus 40 and locking the annulus 40 consists in bringing the second radial tabs 64 of the hooks 58 of the lock 42 downstream into the gap portions 54 of the edge 50 of the groove 32, as shown in FIGS. 9 and 10, and in engaging the catches 66 of the hooks 58 on the downstream face of the edge 44 of the annulus 40.

To do this, suitable tools are inserted in the above-mentioned orifices 72 formed in the second radial tabs 64 in order to pull the second radial tabs 64 axially downstream, either one after another or else all simultaneously, until the upstream radial faces 68 of the catches 66 come to bear against the downstream of the annulus 40 in the gap portions 76 of the inner edge 44 of the annulus 40 and the second radial tabs 64 are in transverse alignment with the solid portions 52 of the edge 50 of the groove 32.

In this position, the annulus 40 has its radially outer end 48 bearing against the roots 14 of the blades 12, the downstream face of the flat ring 56 of the lock 42 bearing against the upstream face of the inner edge 44 of the annulus 40 whose downstream face is bearing against the solid portions 52 of the edge of the groove 32 of the disk 10, the upstream faces 68 of the catches 66 on the hooks 58 of the lock 42 bearing against the downstream face of the annulus 40, and the radial tabs 64 of the hooks 58 are engaged between the solid portions 52 of the edge 50 of the groove 32 of the disk 10 so that the assembly comprising the annulus 40 and the lock 42 is prevented from turning and from moving in translation relative to the disk 10.

The hooks 42 are released by pushing the second radial tabs 64 axially upstream using the above-mentioned tools, and then by turning the annulus 40 and the lock 42 away from the locking position shown in FIG. 8 towards the disassembly position shown in FIG. 6.

What is claimed is:

1. A device for axially retaining blades on a rotor disk of a turbomachine, the device comprising an annulus that is mounted via a radially inner edge in an annular groove of the disk, and that bears via a radially outer edge against the roots of the blades mounted in grooves in the periphery of the disk, the device further comprising an annular lock received in the annular groove of the disk to prevent the annulus from turning in said annular groove, the radially inner edge of the annulus being festooned or crenellated, the annular groove of the disk comprising a radially outer edge that is festooned or crenellated, the annular lock comprising a radially inner portion that is festooned or crenellated, and said annular lock being turnable in the annular groove between an annulus-locking position and a position for mounting and dismounting in the annular groove.

2. A device according to claim 1, wherein the annular lock has hooks for engaging by elastic snap-fastening on the radially inner edge of the annulus and between the solid portions of the radially outer edge of the annular groove in the annulus-locking position.

3. A device according to claim 2, and wherein the hooks of the annular lock are formed on solid portions of its radially inner portion.

4. A device according to claim 2, wherein the hooks of the annular lock comprise radial tabs extending towards the axis of the annular lock from a radially outer annular portion thereof, and axial tabs connected to the radial tabs at one of their ends, and terminating at their other ends in respective catches facing radially outwards and forming members for retaining the radially inner edge of the annulus.

5. A device according to claim 4, wherein the catches of the annular hooks of the lock are designed to engage in part on the annular edges of gap portions of the radially inner edge of the annulus while the annulus is being put into place by movement in axial translation into the annular groove of the disk.

6. A device according to claim 1, wherein, in the locking position of the annulus, solid portions of the radially inner edge of the annulus are axially aligned with solid portions of the radially outer edge of the annular groove to prevent the annulus and the annular lock from moving axially relative to the disk, and the solid portions of the radially inner portion of the annular lock engaged in gap portions of the radially inner edge of the annulus are engaged in the gap portions of the radially outer edge of the annular groove of the disk and are in transverse alignment therewith to prevent the annular lock and the annulus from turning relative to the disk.

7. A device according to claim 4, wherein the axial tabs of the hooks are extended at their ends carrying the catches by respective second radial tabs extending away from the catches, these second radial tabs including means such as orifices for being caught or engaged by tools for applying traction to snap the catches onto the radially inner edge of the annulus, and for applying thrust to disengage the catches from the radially inner edge of the annulus in order to dismount the annulus.

8. A device according to claim 7, wherein the second radial tabs of the annular lock which are engaged in gap portions of the radially outer edge of the annular groove when in the annulus-locking position, are of a shape that is substantially complementary to the shape of said gap portions.

9. A device according to claim 1, wherein, in the annulus-locking position, a radially outer annular portion of the annular lock is pressed axially against the radially inner edge of the annulus which is pressed axially against solid portions of the radially outer edge of the annular groove, and which is clamped axially between the radially outer annular portion of the annular lock and catches of hooks formed on the radially inner portion of said annular lock.

10. A turbomachine comprising a device according to claim 1.

* * * * *